US005647319A

United States Patent [19]

Uehara et al.

[11] Patent Number: 5,647,319

[45] Date of Patent: Jul. 15, 1997

[54] DECOMPRESSION BRAKING APPARATUS FOR DIESEL ENGINE

[75] Inventors: Hirokazu Uehara; Noboru Egashira; Seiji Tsuruta, all of Atsugi, Japan

[73] Assignee: Unisia Jecs Corporation, Atsugi, Japan

[21] Appl. No.: 663,702

[22] Filed: Jun. 14, 1996

[30] Foreign Application Priority Data

Jun. 15, 1995 [JP] Japan ..... 7-148855

[51] Int. Cl.[6] ..... F01L 13/06; F02D 13/04

[52] U.S. Cl. ..... 123/322

[58] Field of Search ..... 123/321, 322, 123/90.16

[56] References Cited

U.S. PATENT DOCUMENTS

| | | | |
|---|---|---|---|
| 2,002,196 | 5/1935 | Ucko | 123/321 |
| 3,367,312 | 2/1968 | Jonsson | 123/321 |
| 5,335,636 | 8/1994 | Bilei et al. | 123/321 |

FOREIGN PATENT DOCUMENTS

| | | | |
|---|---|---|---|
| 2-96406 | 2/1990 | Japan . | |
| 6-17632 | 1/1994 | Japan . | |
| 750441 | 6/1956 | United Kingdom | 123/90.16 |

*Primary Examiner*—Andrew M. Dolinar
*Attorney, Agent, or Firm*—Foley & Lardner

[57] ABSTRACT

In a decompression braking apparatus which is applicable to a Diesel engine and is capable of switching an engine braking condition so as to achieve an appropriate braking force depending upon an engine revolution speed area when a decompression braking request is issued, an eccentric bushing member is pivotally interposed between an inner periphery of a rocker arm and an outer periphery of a rocker shaft fitted into the rocker arm so as to be enabled to displace a swing center of the rocker arm to a first position at which a degree of openings in a closure stroke of an exhaust valve whose valve stem is linked to the rocker arm is relatively small and to a second position at which the degree of openings in the closure stroke thereof is relatively large and an actuator having a plunger linked to the eccentric bushing member hydraulically actuates the eccentric bushing member to pivot so that the swing center of the rocker arm is displaced to either of the first or second position depending on an engine revolution speed when a decompression braking request is issued.

10 Claims, 6 Drawing Sheets

DECOMPRESSION BRAKING APPARATUS FOR DIESEL ENGINE

BACKGROUND OF THE INVENTION

1. Field of the Invention

The present invention relates to a decompression braking apparatus for a Diesel engine used as an engine braking apparatus so as to secure a continuous deceleration of a vehicle in which the Diesel engine is mounted during a vehicular run on a long descending slope independently of using a normally used braking apparatus.

2. Description of the Background Art

An engine braking has widely been applied to an industrial vehicle such as an automotive vehicle other than a forced braking through a normally used braking apparatus and a parking braking apparatus.

A Japanese Patent Application First Publication No. Heisei 6-17632 published on Jan. 25, 1994 exemplifies a first previously proposed decompression braking apparatus for a Diesel engine mounted in a vehicle.

A Japanese Utility Model Registration Application First Publication No. Heisei 2-96406 published on Aug. 1, 1990 exemplifies a second previously proposed decompression braking apparatus for the same.

In the second previously proposed decompression apparatus disclosed in the latter Japanese document, with a valve stem of one of a pair of exhaust valves of each cylinder of the Diesel engine extended, a stopper arm (power tard) is interfered with the extended valve stem of the corresponding one of the exhaust valves, the stopper arm being projected from a hydraulic pressure cylinder, so that a closed state of the corresponding one of the exhaust valves in a closure stroke thereof is limited to a state immediately before a completely closed state, thus achieving a decompression operation of the Diesel engine.

In the first previously proposed decompression braking apparatus disclosed in the former Japanese document, a special profile of a cam lobe of a cam shaft to control the open and closure of the corresponding exhaust valve is set, a rocker arm is provided in association with the specially profiled cam lobe, and an eccentric bushing member is provided so as to be enabled to displace a swing center of the rocker arm. Then, a lever portion of the eccentric bushing member is pivoted in response to a plunger motion according to an actuation of an associated actuator so as to displace the swing center of the rocker arm, thus a degree of openings in the exhaust valve during the closure stroke is switched so as to achieve the decompression braking.

In the second previously proposed decompression braking apparatus, the degree of openings in the exhaust valve during a closure stroke thereof (a spatial quantity by which the exhaust valve in the closed state is held to be slightly open) is constant irrespective of an engine revolution speed at which a decompression braking request is issued.

In the first previously proposed decompression braking apparatus, on the other hand, the vehicular braking state is limited to two states of the decompression braking application and the normally used braking application. The degree of the openings in the exhaust valve during the closure stroke is not varied according to the engine revolution speed at which the decompression braking request is issued, namely according to whether the engine revolution speed is within a relatively high speed area or a relatively low speed area.

It is desired that the degree of the openings in the exhaust valve during its closure stroke as a requirement that the decompression braking apparatus can achieve is relatively small when the engine revolution speed is relatively low and is relatively large when the engine revolution speed is relatively high in terms of an appropriate decompression braking force. However, a heavy burden is imposed on a valve train of the Diesel engine when the degree of openings in the exhaust valve during its closure stroke is set to the relatively small value with the engine revolution speed in the relatively high speed area.

Therefore, in each of the first and second previously proposed decompression braking apparatus, the degree of the openings in the exhaust valve during its closure stroke cannot help being set to the relatively large value (to a value in the case of the high engine revolution speed).

Consequently, the decompression braking force exbibited during the relatively low engine revolution speed accordingly becomes defficient.

SUMMARY OF THE INVENTION

It is, therefore, an object of the present invention to provide a decompression braking apparatus for a Diesel engine which can achieve an appropriate braking force applied to a vehicle in which the Diesel engine is mounted according to an engine revolution speed without a heavy burden imposed on a valve train of a corresponding exhaust valve of each engine cylinder.

The above-described object can be achieved by providing a decompression braking apparatus for a Diesel engine, each cylinder of said Diesel engine having a valve train comprising a rocker arm swingably supported by a rocker shaft so as to open and close an exhaust valve with a swing center of said rocker arm as a center, the swing center of said rocker arm being normally aligned with an axial center of said rocker shaft, said decompression braking apparatus comprising:

a) an eccentric bushing member having one end pivotally interposed between an inner periphery of a hole of said rocker arm and an outer periphery of said rocker shaft fitted into said hole so as to be enabled to displace the swing center of said rocker arm in a downward direction aligned with an opening direction of the exhaust valve; and b) an actuator having a plunger engaged with the other end of said eccentric bushing member and which is so constructed and arranged as to actuate said eccentric bushing member to be pivoted via said plunger, thus said swing center of said rocker arm being displaced in the downward direction to a first position aligned with the opening direction of said exhaust valve so that a degree of openings of the exhaust valve during a closure stroke thereof is relatively small and as to actuate said eccentric bushing member to be pivoted via said plunger, thus said swing center of said rocker arm being displaced in the downward direction to a second position aligned with the opening direction of the valve stem of said exhaust valve so that the degree of the openings of the exhaust valve during the closure stroke is relatively large, said second position being lower than the first position.

The above-described object can also be achieved by providing a decompression braking apparatus for a Diesel engine, each cylinder of said Diesel engine having a rocker arm extended between an upper end of a valve stem of an exhaust valve and an upper end of a push rod, said rocker arm having a swing center with which as a center said rocker arm is swung so as to push the valve stem of the exhaust valve to open the exhaust valve and so as to pull the valve stem of the exhaust valve to close the exhaust valve and a rocker shaft having an axial center thereof and being penetrated and fitted through a hole located around said swing center of said rocker shaft so that a position of said axial center is aligned with that of the swing center, said decompression braking apparatus comprising:

a) an eccentric bushing member having one end pivotally interposed between an inner periphery of said hole of said rocker arm and an outer periphery of said rocker shaft so as to be enabled to displace the swing center of said rocker arm away from said axial center of said rocker shaft; and b) an actuator having a plunger engaged with the other end of said eccentric member and which is so constructed and arranged as to hydraulically actuate said eccentric member to be pivoted via said plunger, thus said swing center of said rocker arm being displaced away from said axial center of said rocker shaft to a first position in a direction aligned with the opening direction of said exhaust valve so that a degree of openings of the exhaust valve during a closure stroke thereof is relatively small or to a second position in the direction aligned with the opening direction of said exhaust valve so that a degree of the openings of the exhaust valve is relatively large, said second position being lower than the first position.

BEST MODE FOR CARRYING OUT THE INVENTION

Reference will hereinafter be made to the drawings in order to facilitate a better understanding of the present invention.

Figure 1A:
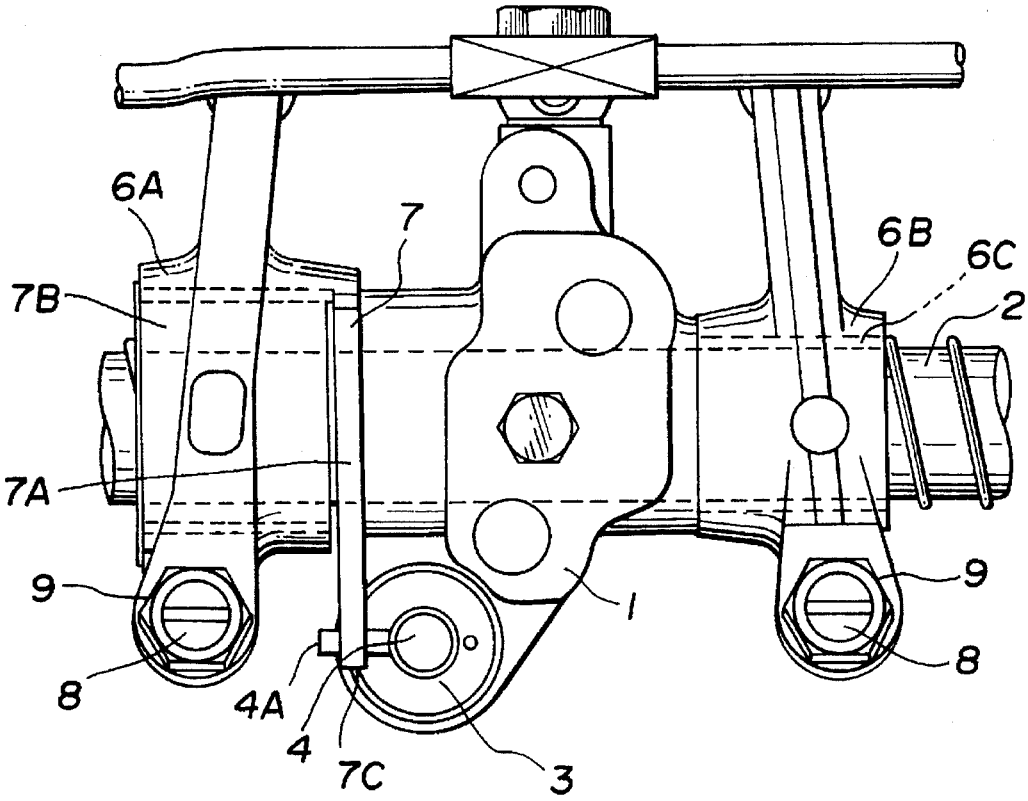
FIG. 1A is a partial top view of a cylinder head of the Diesel engine to which a decompression braking apparatus in a preferred embodiment according to the present invention is applicable.
Figure 1B:
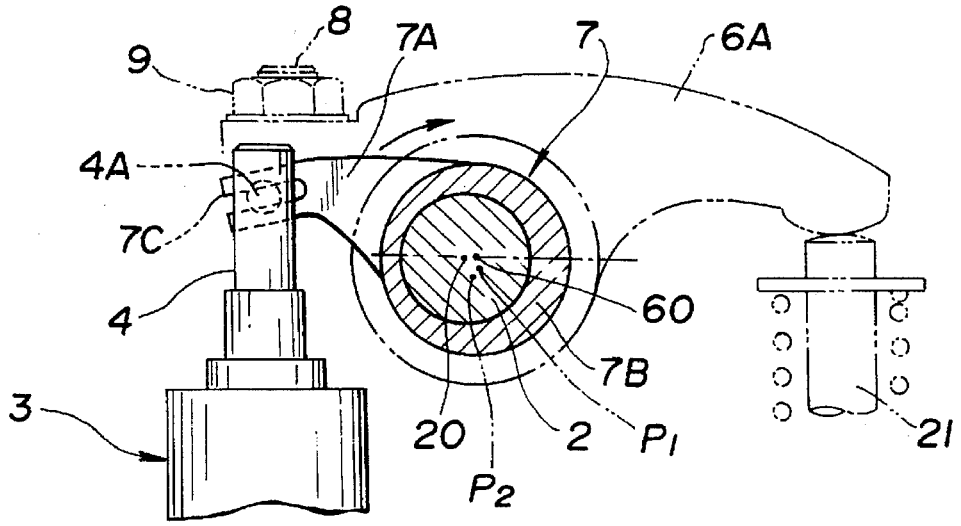
FIG. 1B is an explanatory side view for explaining a positional relationship of a hydraulic pressure actuator with a plunger to a rocker arm of a valve train for one of exhaust valves in a cylinder of the Diesel engine to which the decompression braking apparatus is applicable.

FIGS. 1A and 1B show a preferred embodiment of a decompression braking apparatus for a Diesel engine according to the present invention.

In FIG. 1A, a bracket 1 is attached onto a cylinder head (not specifically shown) and axially supports a rocker shaft 2 extended over the cylinder head of the Diesel engine. An (hydraulic pressure) actuator 3 is integrally installed with the bracket 1, is extended from the bracket 1, and is operated at multiple stages in response to a decompression braking request to a vehicle in which the Diesel engine is mounted according to the present engine revolution speed when the decompression braking request is issued, and a plunger 4 is projected vertically from the actuator 3. Functions of the plunger 4 and its actuator 3 will be described later.

In FIGS. 1A and 1B, the rocker shaft 2 is axially supported on the bracket 1, a rocker arm 6A is provided with a center hole so as to be swingably supported on the rocker shaft 2 via an eccentric lever (eccentric bushing member) 7, and a sleeve of a rocker arm 6B is directly and swingably supported on the rocker shaft 5. It is noted that the rocker arm 6A constitutes a valve train for one of two exhaust valves installed for each cylinder whose degree of openings during its closure stroke is controlled and the other rocker arm 6B constitutes the valve train for the other of the two exhaust valves installed for each cylinder whose degree of openings during its closure stroke is not controlled.

The term swingably means that each rocker arm 6A and 6B is supported on the shaft 2 so as to be enabled to swing about its swing center like a swing arm (lever). In the Diesel engine shown in FIGS. 1A and 1B to which the decompression braking apparatus according to the present invention is applicable, the two exhaust valves are installed for each cylinder of the Diesel engine. One of the two exhaust valves is regulated so as to receive a decompression braking action via the rocker arm 6A. The eccentric bushing member 7 is pivotally incorporated into the hole and fitted between an outer periphery of the rocker shaft 2 and an inner periphery of the rocker arm 6A and so that its pivotal operation of the eccentric member (lever) 7 causes the swing center 60 of the rocker arm 6A aligned with an axial center 20 of the rocker shaft 2 to be displaced toward a downward direction as viewed from FIG. 1B.

The eccentric lever 7 is the eccentric bushing member pivotally fitted into the hole of the rocker arm 6A together with the rocker shaft 2 and which can be actuated to make eccentric a relatively supported position of the rocker arm 6A to the rocker shaft 2, i.e., to be enabled to displace the swing center 60 of the rocker arm 6A in at least a downward direction aligned with an open direction of the exhaust valve as viewed from FIG. 1B. The eccentric lever 7 has a lever portion 7A projected from the hole portion (sleeve portion 7B) toward the corresponding exhaust valve side as shown in FIG. 1B and has the sleeve portion 7B (hole portion) arranged for holding the rocker arm 6A to be enabled for the rocker arm 6A to be made eccentric with respect to the axial center 20 of the rocker arm 6A and its outer periphery is enclosed with the sleeve portion 7B of the eccentric lever 7, the swing center 60 of the rocker arm 6A being aligned with an axial center 20 of the rocker shaft 2.

In FIGS. 1A and 1B, 8 denotes a screw used to adjust a valve clearance of the corresponding exhaust valve, the screw 8 being disposed on an upper end of a push rod 22 (refer to FIG. 6A) associated with & cam of a cam shaft of the valve train of the Diesel engine and 9 denotes a nut on the screw 8.

Figure 2:
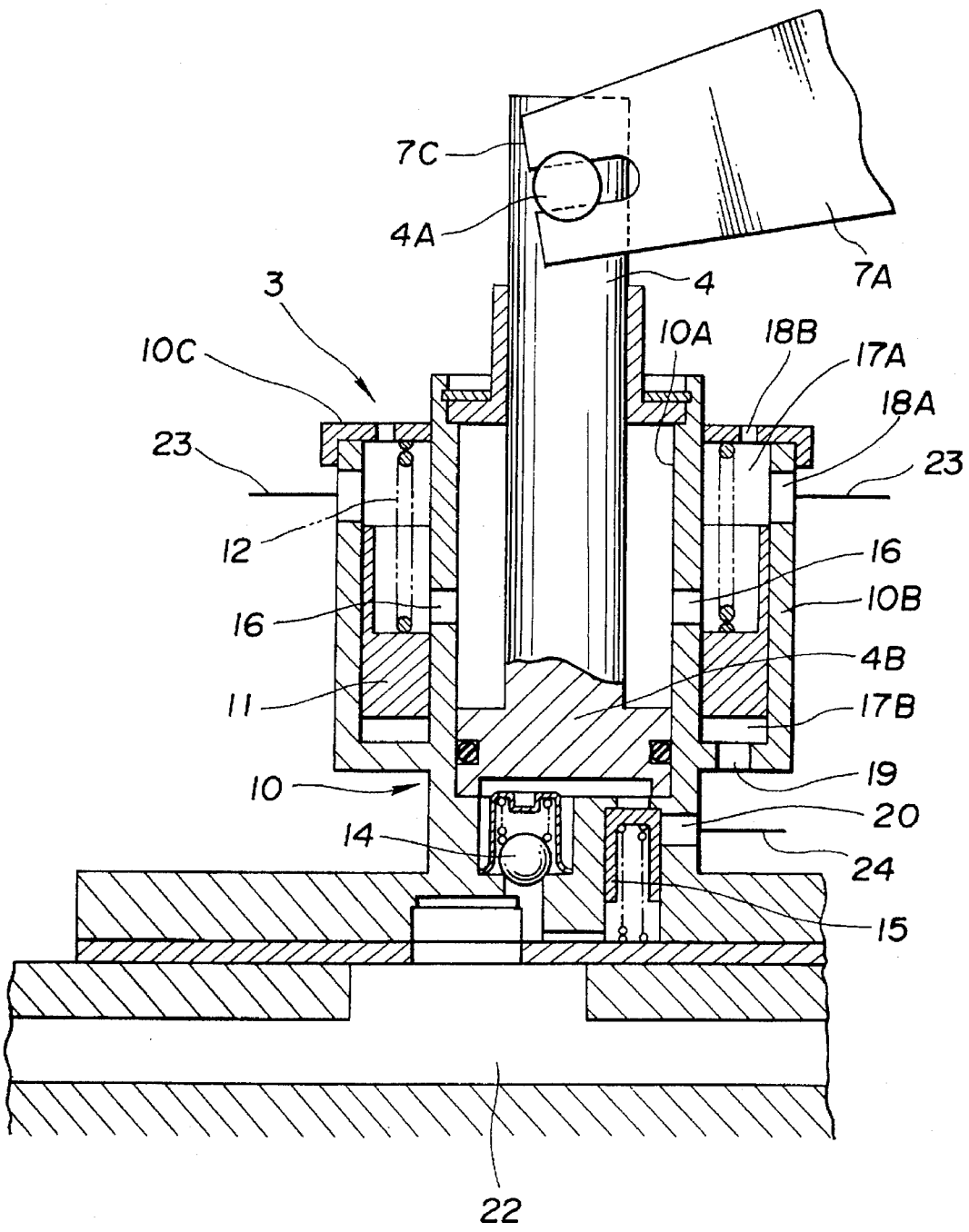
FIG. 2 is a partially cross sectional view of the hydraulic pressure actuator with the plunger when the Diesel engine is normally driven and with no decompression braking applied.
Figure 3:
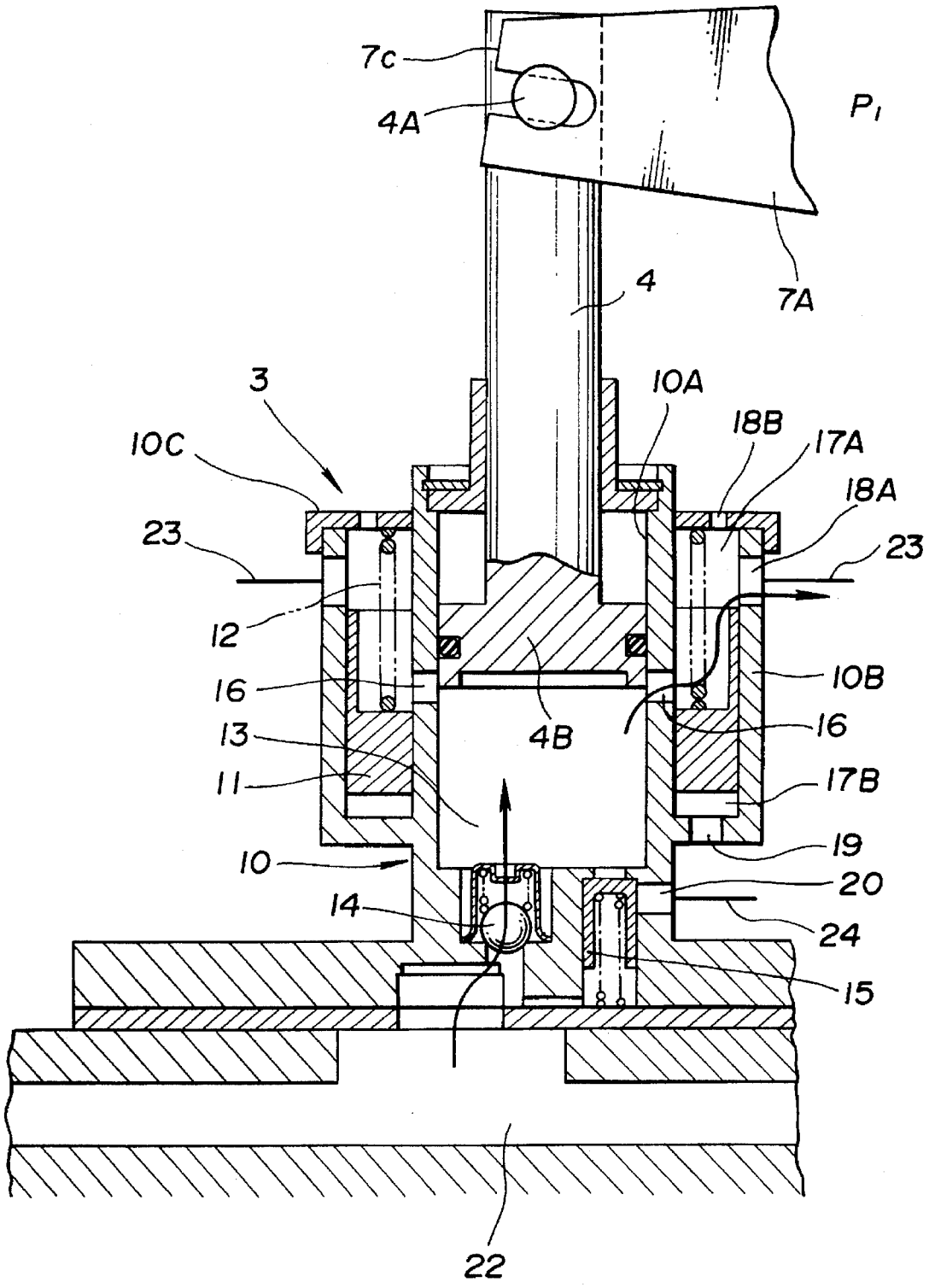
FIG. 3 is a partially cross sectional view of the hydraulic pressure actuator with the plunger when an engine revolution speed falls in a relatively low speed area with a decompression braking request issued.
Figure 4:
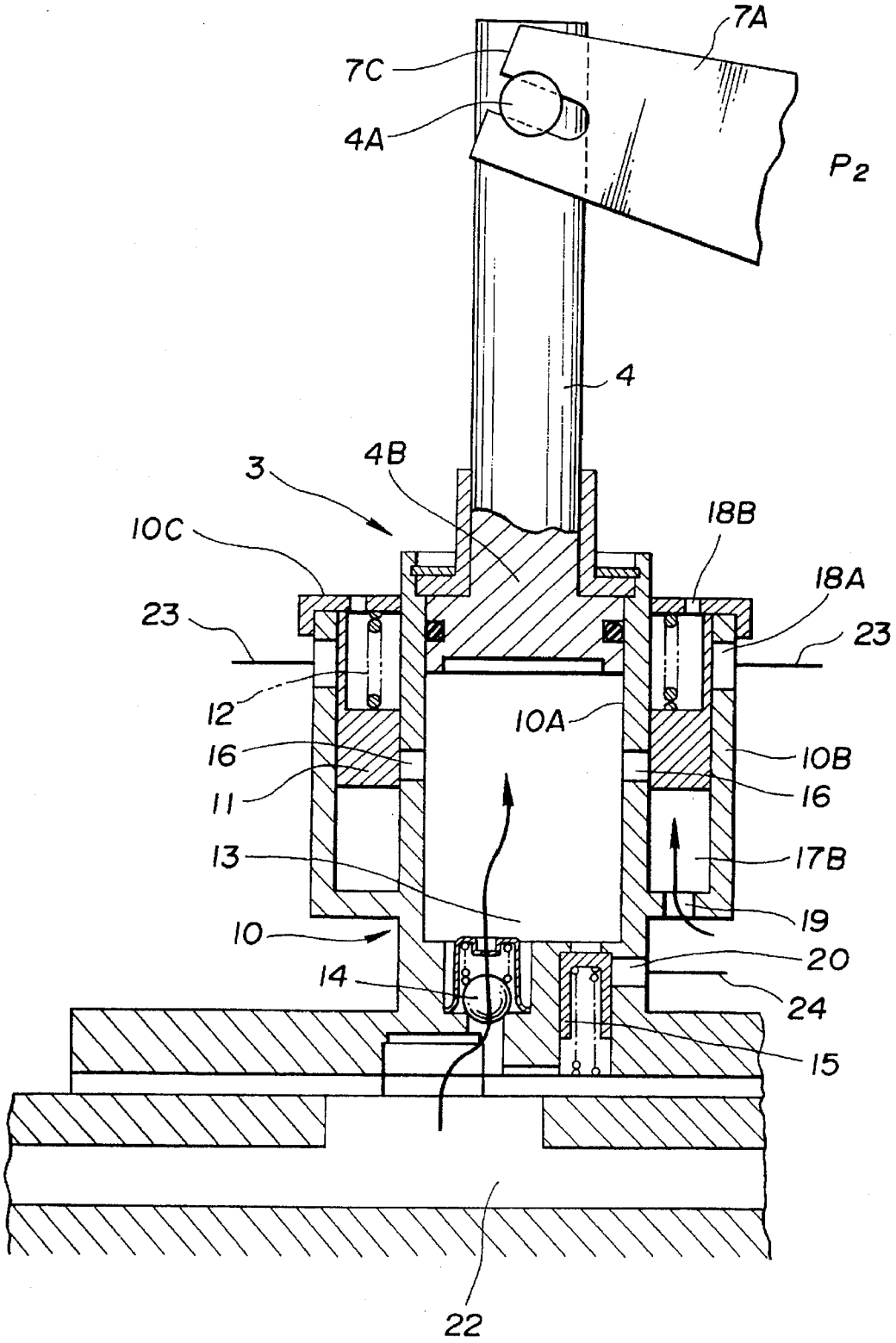
FIG. 4 is a partially cross sectional view of the hydraulic pressure actuator with the plunger when an engine revolution speed falls in a relatively high speed area with a decompression braking request issued.

FIGS. 2, 3, and 4 show a structure of the actuator 3 having the plunger 4 and are explanatory views of the actuator 3 for explaining a series of operations of the actuator 3.

FIG. 2 shows postures of the actuator 3 and lever portion 7A of the eccentric bushing member (lever) 7 when the Diesel engine is normally driven, i.e., when no decompression braking request occurs and the vehicle is running.

FIGS. 3 and 4 show the postures of the actuator 3 and lever portion 7A of the eccentric member 7 when the decompression braking request occurs, the engine revolution speed falling in the relatively low speed area and falling in the relatively high speed area, respectively.

As shown in FIGS. 2, 3, and 4, a body 10 of the actuator 3 is formed in approximately double cylinder shapes having an inner cylinder portion 10A and an outer cylinder portion 10B.

The plunger 4, i.e., a piston portion 4B of the plunger 4 is slidably installed within the inner cylinder portion 10A so as to be enabled to slide vertically along the inner cylinder portion 10A.

A ring-shaped piston member 11 (also called, a stroke switching piston) is installed between the inner cylinder portion 10A and the outer cylinder portion 10B so as to be enabled to slide vertically along the outer cylinder portion 10B. A piston return spring 12 is interposed between a lid 10C located on an upper end of the outer cylinder portion 10B and the piston member 11.

In addition, referring to FIGS. 2 and 3, a (main) hydraulic pressure chamber 3B is formed within the inner cylinder portion 10A. A check valve 14 used to limit the flow direction of hydraulic pressure (working fluid) toward the hydraulic pressure chamber 13 is provided within a lower wall of the inner cylinder portion 10A. A hydraulic pressure draining valve 15 (so called, free piston) is installed within the lower wall of the inner cylinder portion 10A adjacent to the check valve 15 and is used to drain the hydraulic pressure in the hydraulic pressure chamber 13.

A communication hole 16 is penetrated through a side wall of the inner cylinder portion 10A.

Upper and lower hydraulic pressure chambers 17A and 17B are defined by means of the inner and outer cylinder portions 10A and 10B.

Furthermore, the upper hydraulic pressure chamber 17A is provided with an exhaust hydraulic pressure hole 18A on a side wall of the outer cylinder portion 10B and with a ventilation hole 18B on the lid 10C. A hydraulic pressure communication hole 19 is provided on the wall defining the lower hydraulic pressure chamber 17B and used to supply and drain the hydraulic pressure to and from the lower hydraulic pressure chamber 17B.

A hydraulic pressure passage 20 is penetrated through the lower wall of the inner cylinder portion 10A and linked to the draining (hydraulic pressure) valve 15 (free piston) for introducing the drained hydraulic pressure via the draining hydraulic pressure valve (free piston) 15 therethrough.

The draining hydraulic pressure valve 15 (free piston) serves to open the hydraulic pressure chamber 13 when the hydraulic pressure applied onto its upper wall of the valve body exceeds the hydraulic pressure applied onto its lower wall of the valve body from the oil passage 22, the hydraulic pressure in the hydraulic pressure chamber being drained to the oil passage 20 when it is open.

Next, the series of the operations of the actuator 3 thus constructed will be explained in a case when the decompression (engine) braking is applied, the engine revolution speed falling in the relatively high speed area or in the relatively low speed area.

FIGS. 1B and 2 show the relative positions of the eccentric bushing member 7 and the actuator 3 when the Diesel engine is normally driven with no decompression (engine) braking applied, i.e., when the engine is in the driving state.

That is to say, at this time, the sleeve portion 7B of the eccentric bushing member 7 is fitted into the hole of the rocker arm 6A so that the swing center 60 of the rocker arm 6A is maintained at the same height as the axial center 20 of the rocker shaft 2 (the swing center 60 being aligned with the axial center of the rocker shaft 2).

Figure 6A:
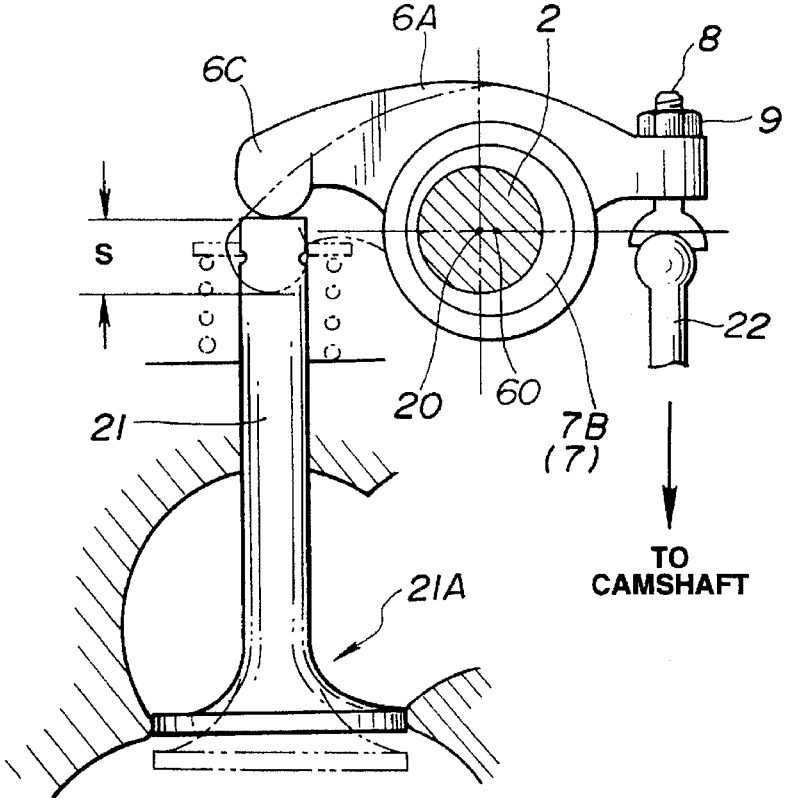
FIG. 6A is an explanatory view of a valve lift stroke S of the exhaust valve with a swing center (20) of the rocker arm aligned with an axial center of a rocker shaft.

In this state shown in FIG. 1B, a valve opening and closure operation of the corresponding exhaust valve 21A (refer to FIG. 6A) is carried out through a swing motion of the rocker arm 6A via its valve stem 21 of the exhaust valve 21A so that the exhaust valve 21A is open and closes in a normal stroke (lift stroke S shown in FIG. 6A).

Suppose now that the decompression braking request occurs in a state shown in FIGS. 1B and 2 when the engine revolution speed falls in a previously set low engine revolution speed area.

At this time, the hydraulic pressure generated by an oil pump (refer to FIG. 6B) in an engine hydraulic circuit is supplied to the first hydraulic passage 22 via a first control valve (S/W solenoid valve shown in FIG. 6B) and introduced into the hydraulic pressure chamber 13 of the inner cylinder portion 10A via the check valve 14. The hydraulic pressure introduced into the hydraulic pressure chamber 13 causes the plunger 4 to be pushed upward via a pin 4A received by a recess of the end of the lever 7A of the eccentric bushing member 7 so that the lever portion 7A of the eccentric bushing member 7 is pivoted as shown in FIG. 3. With the plunger 4 operated to move upward at the position shown in FIG. 3, the hydraulic pressure chamber 13 is communicated with the upper chamber 17A of the outer cylinder portion 10B via the communication hole 16 so that the hydraulic pressure is returned from the upper chamber 17A to the oil returning tube 23 via the hydraulic pressure exhaust holes 18, as denoted by an arrow-marked line of FIG. 3.

Figure 5:
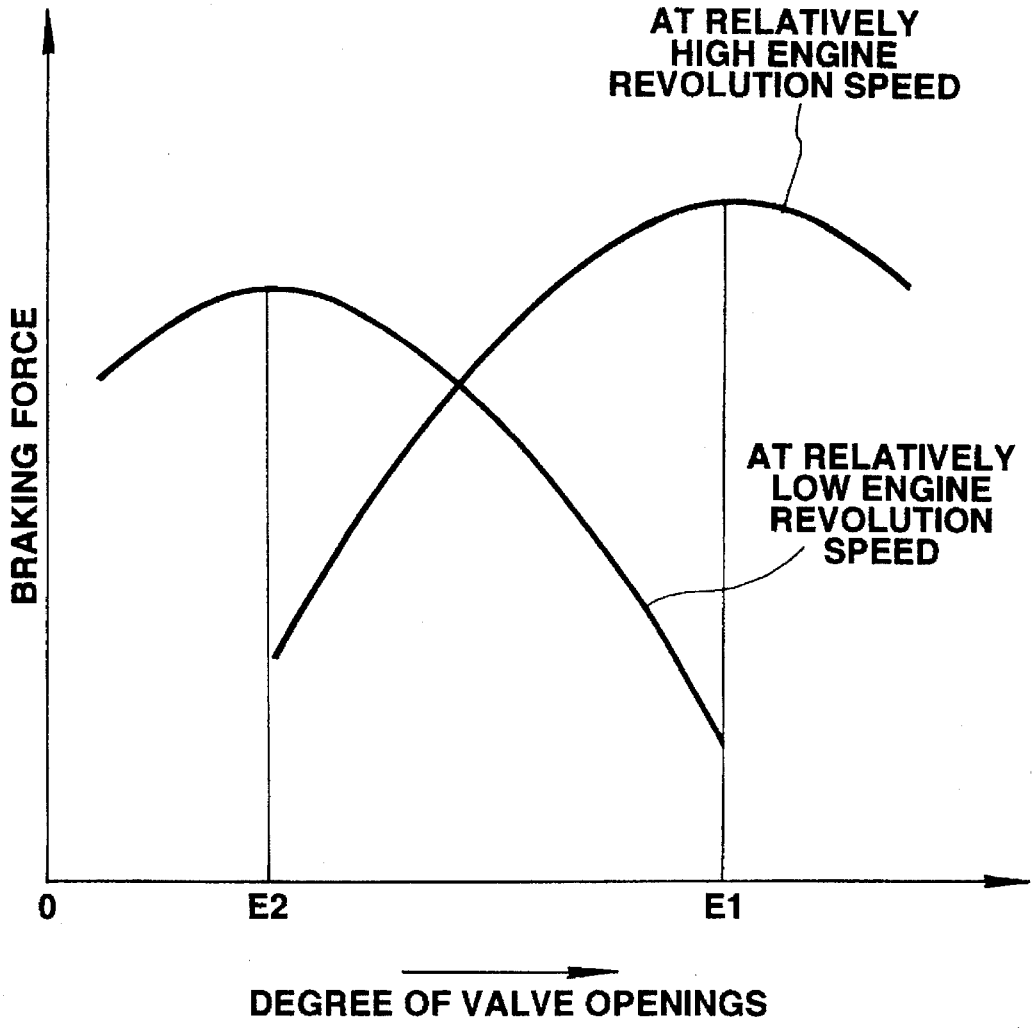
FIG. 5 is characteristic graphs, each representing a relationship between an engine braking force and a degree of openings in the exhaust valve during the closure stroke to be used to set the degrees of the openings in the exhaust valve during its closure stroke in the decompression braking apparatus according to the present invention.

In this way, the plunger 4 is held at a state shown in FIG. 3 unless the hydraulic pressure supply is interrupted from the first hydraulic pressure passage 22. Consequently, the swing center 60 of the rocker arm 6A shown in FIG. 1B is displaced at a first position $P_1$ (refer to FIG. 1B) lower than the axial center 20 of the rocker shaft 2. Thus, the displacement permits a holding of a relatively small degree of valve openings (E2) of the corresponding exhaust valve (refer to FIG. 5) during a final stage of the valve closing stroke. When the decompression braking demand is released, the supply of the hydraulic pressure to the first hydraulic pressure passage 22 is halted by means of the first control valve (S/W solenoid valve) and the draining hydraulic pressure valve 15 is operatively opened to drain the hydraulic pressure chamber 13 toward the hydraulic pressure passages 20 and 24 and is returned to the original hydraulic pressure circuit (refer to FIG. 6B). Thus, the plunger 4 is returned to the original position in the hydraulic pressure chamber as shown in FIG. 2.

On the other hand, suppose now that the decompression braking request occurs in the state shown in FIG. 2, the engine revolution speed falling in the previously set high speed area (a boundary between the previously set high and low speed areas is, in the embodiment, 2000 rpm, so that the previously set high speed area is above 2000 rpm).

At this time, the hydraulic pressure generated by the oil pump (refer to FIG. 6B) is supplied to the lower hydraulic pressure chamber 17B defined by the outer cylinder portion 17B via the lower hydraulic pressure communication hole 19 together with the hydraulic pressure supply to the hydraulic pressure chamber 13 via the check valve 14 having a spherical valve body.

Hence, the ring-shaped piston member 11 is driven upward against the biasing force of the return spring 12 so that the communication hole 16 penetrated through the side wall of the inner cylinder portion 10A so as to communicate between the hydraulic pressure chamber 13 of the inner cylinder portion 10A and the upper hydraulic pressure chamber 17A of the outer cylinder portion 10B is closed by means of the stroke switching piston 11. Consequently, the plunger 4 is moved in the further upward direction to a highest position shown in FIG. 4 (a lower flange of the piston portion 4B of the plunger 4 is brought in close contact with the upper wall of the inner cylinder portion 10A).

At this time, the lever portion 7A of the eccentric lever 7 is pivoted in the further clockwise direction from the state shown in FIG. 3 so that the swing center 60 (refer to FIG. 1B) of the rocker arm 6A can be lowered furthermore (to a second position $P_2$ shown in FIG. 1B) than that ($P_1$) shown in FIG. 3. Thus, the degree of valve openings of the exhaust valve 21A during its closure stroke can be maintained at the large value (E1) of FIG. 5.

In addition, in a case where the decompression braking application is released, the hydraulic pressure supply to the hydraulic pressure chamber 13 and to the lower hydraulic chamber 17B defined by the outer cylinder portion 10B is halted and the remaining hydraulic pressure 13 and in the lower hydraulic pressure chamber 17B is drained through the hydraulic pressure returning tube (outlet) 23 and the hydraulic pressure communication hole 19.

Thus, the plunger 4 is returned, i.e., moved down to the original position shown in FIG. 2.

Furthermore, if only the hydraulic pressure supply to the lower hydraulic pressure supply chamber 17B is halted with the decompression braking state shown in FIG. 4, it is possible to render the plunger 4 in the decompression braking state in the case of the relatively low engine speed area shown in FIG. 3.

FIG. 6A shows the relationship between the exhaust valve 21A and the rocker arm 6A.

When one end of the rocker arm 6A linked to the push rod 22 is swung upward due to the motion of the cam lobe of the cam shaft, the other end of the rocker arm 6A is forced to push the upper end of the valve stem 21 of the exhaust valve 21A against the biasing force of the valve spring (denoted by a phantom line) so that the exhaust valve 21A is in its completely open state. When the one end of the rocker arm 6A is swung downward due to the motion of the cam lobe of the cam shaft, the other end of the rocker arm 6A is returned back to pull the upper end of the valve stem 21 of the exhaust valve 21A together with the biasing force of the valve spring so that the exhaust valve 21A is in its completely closed state. The symbol S denotes the lift stroke of the exhaust valve 21A between its completely open state and its completely closed state. The relatively small value of degree of valve openings in the exhaust valve 21A during its closure stroke in the case when the swing center 60 is displaced to the first position $P_1$ corresponds to E2 of FIG. 5, i.e., larger than zero (completely closed) but smaller than the value corresponding to E1 of FIG. 5.

Figure 6B:
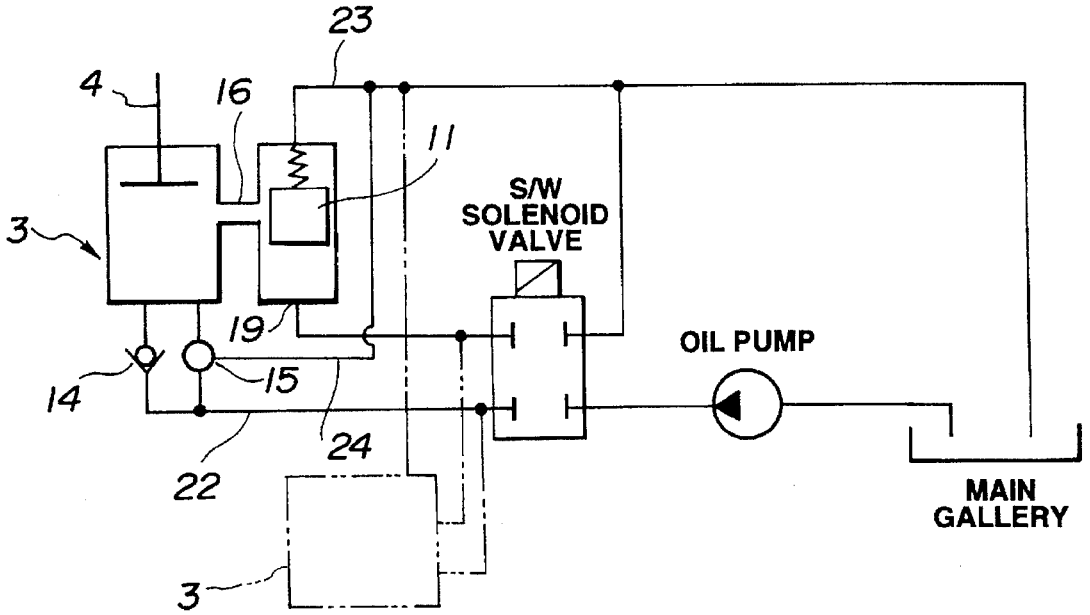
FIG. 6B is a schematic diagram of a hydraulic pressure circuit around the hydraulic pressure actuator shown in FIGS. 1B and 2 through 4.

FIG. 6B shows an example of the hydraulic pressure circuit around the actuator 3 in the Diesel engine. Each actuator 3 is provided for each cylinder of the Diesel engine. It is noted that the lubricating circuit of the Diesel engine is utilized to supply the hydraulic pressure supplied to each actuator 3 in the decompression braking apparatus.

In the embodiment, the Diesel engine to which the decompression braking apparatus according to the present invention is applicable is provided with the two exhaust valves for each cylinder.

The present invention is also applicable to the Diesel engine in which one exhaust valve for each cylinder is installed.

The boundary between the low speed area and the high speed area is set to 2000 rpm in the embodiment described above. However, such a boundary between the relatively high speed area and the relatively low speed area may be set arbitrarily according to the characteristic related to the engine revolution speed of the Diesel engine.

What is claimed is:

1. A decompression braking apparatus for a Diesel engine, each cylinder of said Diesel engine having a valve train comprising a rocker arm swingably supported by a rocker shaft so as to open and close an exhaust valve with a swing center of said rocker arm as a center, the swing center of said rocker arm being normally aligned with an axial center of said rocker shaft, said decompression braking apparatus comprising:

a) an eccentric bushing member having one end pivotally interposed between an inner periphery of a hole of said rocker arm and an outer periphery of said rocker shaft fitted into said hole so as to be enabled to displace the swing center of said rocker arm in a downward direction aligned with an opening direction of the exhaust valve; and b) an actuator having a plunger engaged with the other end of said eccentric bushing member and which is so constructed and arranged as to actuate said eccentric bushing member to be pivoted via said plunger, thus said swing center of said rocker arm being displaced in the downward direction to a first position aligned with the opening direction of said exhaust valve so that a degree of openings of the exhaust valve during a closure stroke thereof is relatively small and as to actuate said eccentric bushing member to be pivoted via said plunger, thus said swing center of said rocker arm being displaced in the downward direction to a second position aligned with the opening direction of the valve stem of said exhaust valve so that the degree of the openings of the exhaust valve during the closure stroke is relatively large, said second position being lower than the first position.

2. A decompression braking apparatus for a Diesel engine as claimed in claim 1, wherein said plunger of said actuator includes a pin projected from an elongated wall of said plunger, said pin being slidably engaged with a recess formed on the other end of said eccentric bushing member and wherein said actuator further comprises an inner cylinder portion and a hydraulic pressure chamber defined by the inner cylinder portion and from which said plunger is extended vertically so that said plunger is projected in an upward direction from said hydraulic pressure chamber when a hydraulic pressure is introduced into said hydraulic pressure chamber, thus said eccentric bushing member being pivoted via said pin to displace the swing center of said rocker arm to said first position or to said second position.

3. A decompression braking apparatus as claimed in claim 2, wherein said actuator further comprises: an outer cylinder portion formed around said inner cylinder portion; a communication hole penetrated through a side wall of said inner cylinder portion so as to be enabled to drain the hydraulic pressure in said hydraulic pressure chamber when said plunger is projected in the upward direction so that the eccentric bushing member is pivoted via said pin and so that said swing center of said rocker arm is displaced to the first position; upper and lower hydraulic pressure chambers formed by the inner and outer cylinder portions, the upper hydraulic pressure chamber receiving the hydraulic pressure chamber drained from the communication hole when said plunger is projected to a position corresponding to the first position of the swing center; and a piston member defining the upper and lower hydraulic pressure chambers together with the said inner and outer cylinder portions.

4. A decompression braking apparatus as claimed in claim 3, wherein said actuator further comprises a hydraulic pressure draining hole located at a lower end of said outer cylinder position so as to be enabled to drain the hydraulic pressure in said lower hydraulic pressure chamber, thus the hydraulic pressure in said hydraulic pressure chamber being introduced into the upper hydraulic pressure chamber via said communication hole with the piston member moved downward to the hydraulic pressure draining hole and said plunger being retracted in the downward direction so as to pivot said eccentric bushing member, thereby the swing center of said rocker arm being displaced to an original position which is aligned with the axial center of said rocker shaft.

5. A decompression braking apparatus as claimed in claim 4, wherein said actuator further comprises a check valve disposed within an oil passage formed in the inner cylinder to introduce the hydraulic pressure into said hydraulic pressure chamber so as to limit a direction of flow of the hydraulic pressure into the hydraulic pressure chamber and wherein the hydraulic pressure is supplied to the lower hydraulic pressure chamber via said draining hydraulic pressure hole located at the lower end of said outer cylinder portion together with the hydraulic pressure supply to the hydraulic pressure chamber so that the communication hole is closed by the piston member and the plunger is projected further in the upward direction to a position corresponding to the second position of the swing center of the rocker arm.

6. A decompression braking apparatus as claimed in claim 5, wherein said actuator further comprises a draining passage formed on a side wall of said outer cylinder portion so as to be enabled to drain the hydraulic pressure in said upper hydraulic pressure chamber externally so that said plunger is retracted to the original position within said hydraulic pressure chamber, thus the eccentric bushing member being pivoted to an original position to return the swing center of said rocker arm to its original position aligned with the axial center of said rocker shaft.

7. A decompression braking apparatus as claimed in claim 6, wherein said actuator further comprises a free piston disposed within another oil passage of said hydraulic pressure chamber so as to open the other oil passage of said hydraulic pressure chamber to drain the hydraulic pressure in said hydraulic pressure chamber when the hydraulic pressure in said hydraulic pressure chamber exceeds the hydraulic pressure in said oil passage linked to the check valve.

8. A decompression braking apparatus as claimed in claim 7, wherein said actuator further comprises a spring member extended between an upper end of said outer cylinder portion and said piston member so that said piston member is moved downward to the lower hydraulic pressure chamber to open said communication hole due to its spring force.

9. A decompression braking apparatus as claimed in claim 1, wherein each cylinder of said Diesel engine has two exhaust valves and wherein the degree of openings in the closure stroke of one of the two exhaust valves is varied according to the pivotal movement of said eccentric bushing member.

10. A decompression braking apparatus for a Diesel engine, each cylinder of said Diesel engine having a rocker arm extended between an upper end of a valve stem of an exhaust valve and an upper end of a push rod, said rocker arm having a swing center with which as a center said rocker arm is swung so as to push the valve stem of the exhaust valve to open the exhaust valve and so as to pull the valve stem of the exhaust valve to close the exhaust valve and a rocker shaft having an axial center thereof and being penetrated and fitted through a hole located around said swing center of said rocker shaft so that a position of said axial center is aligned with that of the swing center, said decompression braking apparatus comprising:

a) an eccentric bushing member having one end pivotally interposed between an inner periphery of said hole of said rocker arm and an outer periphery of said rocker shaft so as to be enabled to displace the swing center of said rocker arm away from said axial center of said rocker shaft; and b) an actuator having a plunger engaged with the other end of said eccentric member and which is so constructed and arranged as to hydraulically actuate said eccentric member to be pivoted via said plunger, thus said swing center of said rocker arm being displaced away from said axial center of said rocker shaft to a first position in a direction aligned with the opening direction of said exhaust valve so that a degree of openings of the exhaust valve during a closure stroke thereof is relatively small or to a second position in the direction aligned with the opening direction of said exhaust valve so that a degree of the openings of the exhaust valve is relatively large, said second position being lower than the first position.

* * * * *